US005881508A

United States Patent [19]

Irvine et al.

[11] Patent Number: 5,881,508

[45] Date of Patent: Mar. 16, 1999

[54] DECKING EXTRUSION

[75] Inventors: John E. Irvine, Atlanta; John J. Yeosock, Dunwoody; Steve E. Hargrave, Roswell, all of Ga.

[73] Assignee: Materials International, Inc., Atlanta, Ga.

[21] Appl. No.: 943,674

[22] Filed: Oct. 15, 1997

[51] Int. Cl.[6] ..... E04F 15/00; E04B 5/00

[52] U.S. Cl. ..... 52/177; 52/579; 52/588.1; 52/489.1; 52/732.2; 405/219

[58] Field of Search ..... 52/177, 579, 581, 52/588.1, 489.1, 732.2, 731.1; 405/218, 219

[56] References Cited

U.S. PATENT DOCUMENTS

| | | | |
|---|---|---|---|
| 3,043,407 | 7/1962 | Marryatt | 52/177 X |
| 3,046,852 | 7/1962 | Graham | 52/581 |
| 3,282,005 | 11/1966 | Birdwell | 52/364 |
| 3,555,762 | 1/1971 | Costanzo, Jr. | 52/177 X |
| 3,587,503 | 6/1971 | Stehr | 114/0.5 |
| 4,349,297 | 9/1982 | Misener | 405/221 |
| 4,352,597 | 10/1982 | Kay | 405/219 |
| 4,718,213 | 1/1988 | Butterfield | 52/731 |
| 4,944,545 | 7/1990 | Simme | 296/43 |
| 4,947,595 | 8/1990 | Douds et al. | 52/177 |
| 4,987,717 | 1/1991 | Dameron, Jr. | 52/731 |
| 5,009,045 | 4/1991 | Yoder | 52/117 |
| 5,031,083 | 7/1991 | Claesson | 362/249 |
| 5,048,448 | 9/1991 | Yoder | 114/263 |
| 5,050,362 | 9/1991 | Tal et al. | 52/579 X |
| 5,152,119 | 10/1992 | Miller | 52/731 |
| 5,442,885 | 8/1995 | Laven et al. | 52/731.3 |
| 5,613,339 | 3/1997 | Pollock | 52/731.1 |
| 5,735,097 | 4/1998 | Cheyne | 52/489.1 |

FOREIGN PATENT DOCUMENTS

| | | | |
|---|---|---|---|
| 1506750 | 12/1967 | France | 52/588.1 |

OTHER PUBLICATIONS

Royal Deck Advertisement.
Brock Dock Advertisement.
DreamDocks Advertisement.
Sheerline Advertisement (Maintenance Free Deck System).
P.V.C. Lumber System Advertisement.
Tech Deck Advertisement.
Sheerline Advertisement (Deck System Components).

*Primary Examiner*—Carl D. Friedman
*Assistant Examiner*—Winnie Yip
*Attorney, Agent, or Firm*—Thomas, Kayden, Horstemeyer & Risley

[57] ABSTRACT

A decking extrusion for use in forming the deck members used to construct outdoor decks, docks, and similar structures is disclosed. The extrusion has an elongate planar base panel (7) with a first elongate side edge (8), and a spaced parallel elongate second side edge (9). At least one first elongate leg member (12) extends the length of the first side edge of the base panel, and at least one elongate second leg member (15) spaced from and parallel to the first leg member extends the length of the second side edge of the base panel. A first locking element (17) is formed at the distal end of the first leg member, and a corresponding locking element (30), sized and shaped to receive a second one of the first locking elements therein, is formed at the distal end of the second leg member. The extrusion may also be provided with an intermediate stiffening leg (126) having a transverse flange (127) formed at its distal end parallel to the base panel to add structural rigidity to the extrusion. Two identical ones of the extrusion are joined together to form an elongate deck member by placing the two extrusions in a 180° reverse relationship with respect to one another such that the second locking element of the second extrusion is received on the first locking element of the first extrusion, while the first locking element of the second extrusion is received on the second locking element of the first extrusion, respectively, whereupon the extrusions are joined together in a snap-fit at the respective locking elements to form an elongate hollow box beam or deck member.

34 Claims, 5 Drawing Sheets

DECKING EXTRUSION

FIELD OF THE INVENTION

This invention relates in general to structural extrusions. More particularly, this invention relates to a one-piece elongate extrusion made of either a virgin or recycled plastic material for use as a load bearing structural component in outdoor decks, docks, and similar structures.

BACKGROUND OF THE INVENTION

Dimensional lumber has long been used in the construction of outdoor structures, to include decks attached to homes, or docks used for access to watercraft, for example. Dimensional lumber offers the advantage of relatively low cost, and it can be quickly and easily cut to size and joined together to form the desired structure. However, a significant disadvantage when using dimensional lumber in outdoor applications, even if the lumber is pressure treated. is the fact that the lumber is exposed to the elements, and over time the lumber will inevitably begin to crack, split, fade, and splinter. This problem can be overcome by painting or staining the exposed surfaces of the lumber and by performing periodic maintenance on the structure, but this becomes a time consuming and expensive ordeal as the lumber weathers over time. Also, lumber is significantly affected by ambient weather conditions, primarily heat and moisture, so that the lumber tends to warp or twist over time.

In the effort to combat these known problems with the use of dimensional lumber in constructing decks and docks, the use of extruded structural components has been developed. These extrusions may be either of a plastic or a metallic material for example, aluminum, or the decking planks may even be comprised of a plastic resin, as was done in U.S. Pat. No. 4,349,297 to Misener. Common examples of extruded decking/docking systems are disclosed in U.S. Pat. Nos. 4,947,595 to Douds, et al., disclosing an extruded metal plank for use in the construction of deck surfaces; 5,009,045, and 5,048,448 to Yoder, disclosing a plank structure for a boat dock and the like, as well as a boat dock structure, respectively; and, more recently, in U.S. Pat. No. 5,613,339 to Pollock, which discloses a decking system using two different extrusions of two different constructions which, when joined together, form an elongate deck plank.

Although the aforementioned patents provided deck planks, or dock structures which address the problems of dimensional lumber, problems still persist with the use of this type of extruded decking. For example, in the patent to Douds, et al., the extruded metal plank most closely resembles decking used in industrial applications, and does not appear to be particularly well-suited for use in residential applications, for example the construction of home decks and docks, due to cost considerations coupled with the fact that exposed flanges are left as a part of the deck extrusion which might lead to accidental injury. Also, as the extrusion of Douds, et al. is made of metal, it may tend to burn the feet of people walking barefoot on a sun exposed deck, as would commonly occur on non-commercial decks or docks, and may be relatively slippery when wet.

Similarly, the '448 patent to Yoder discloses a plank structure for a boat dock which has the disadvantage that a first extruded plastic strip of a first design must be secured to the frame of the deck or dock structure, the strip having a number of protrusions formed therein for receiving the plank structure of the '045 Yoder patent, which thus necessitates that these spaced and opposed strips be precisely aligned with one another during construction of the deck/dock, which, as any person of ordinary skill in the construction arts is aware, becomes a difficult task in the field. Thereafter, an extrusion of a second different construction, the extruded "plank" of the '045 patent, must be positioned over the spaced, parallel, and aligned extrusions disclosed in the '448 Yoder patent, and then fastened thereto.

Similarly, the patent to Pollock discloses a first extrusion which must be placed on the support structure of the deck or dock and fastened thereto, whereupon a second, different extrusion is positioned on top of the first extrusion, and snapped into place to form the deck plank. Moreover, Pollock teaches that these two extrusions are formed of two different plastics, the second or surface extrusion being made of a more pliable material. Similarly, the '045 Yoder patent also discloses the use of two differing plastic materials to extrude the second of the two decking system extrusions used.

Although the patents to Yoder and Pollock offer the advantage of a plastic material, which is well suited for use in residential applications, these patents have the disadvantage that two differing extrusions are used which must be "joined" together to form the deck or dock structure during construction in the field. This necessitates that two different extrusions be manufactured, at significant expense as this impacts the costs of designing and tooling the differing extrusion dies to be used, as well as increasing material costs in that an inventory of two different extrusions must be maintained in order to be able to sell the boat dock structure, or deck plank of the Yoder and Pollock patents, respectively.

One-piece metallic extrusions have been developed which have been constructed and arranged to be fastened to one another in a 180° reverse relationship to form an elongate structural member. Examples of such extrusions are disclosed in U.S. Pat. Nos. 3,282,005 to Birdwell; 4,987,717 to Dameron, Jr.; and 5,031,083 to Claesson. These extrusions, however, appear to be poorly suited for use as load bearing structural components in deck and dock applications, and instead appear to be specialty extrusions. For example, the extrusion of Birdwell is a single one-piece extrusion which is placed in a 180° reverse relationship by sliding the two extrusions together, along their length and end first, to loosely mate them together, whereupon the two extrusions are then tack-welded to hold them in position relative to one another, in conjunction with spacer shims placed between the two extrusions so that the extrusion is loosely formed as a structural box beam. Thereafter, the extrusion is then fastened to a building, for example a building facade, as a decorative and not a load-bearing component by placing spaced fasteners through the slot between the two extrusions to complete the "formation" of the box beam.

Similarly, the extrusion of Dameron, Jr. appears also to be used for decorative and/or non load-bearing purposes, only, although it may also be used as used as a gutter facade, i.e. as a gutter, along the roof line of a residential or commercial structure. The extrusion of Dameron, Jr. may also be used as a box beam, however, but apparently only as a decorative facia or other non-load bearing structural/aesthetic component. The extrusions of Dameron, Jr., as well as the extrusion to Birdwell, are mated by sliding two identical extrusions together, ends first and along their length, once placed in an overlying 180° reverse relationship with respect to one another, to form the extrusions into a box beam. Moreover, the extrusion of Dameron, Jr. would not be useful as a deck or dock component because it appears to be much too fragile to carry or support a load along its length, and its method of assembly is highly impractical for decks/docks because it would require workers to be positioned on ladders outside or off of the structural support framework of the deck or dock, to include even standing in, or floating on water, for example, in order to slide the two extrusions together to form the box beam once a first of the extrusions is fastened to the support framework. This is extremely unworkable in that the construction of decks and docks requires not only speed and efficiency, but safety as well when constructing the structure.

The extrusion of Claesson is used for creating cable runs in which electrical cables, for example, are housed. The extrusion of Claesson, however, also makes provision for the placement of light-emitting diodes, or other light-emitting devices thereon, so that two extrusions, when placed together, form an elongate "box beam" which can apparently be used for decorative purposes also. The extrusion of Claesson, however, offers the disadvantages that it does not have a uniform cross-section which thus leads to differential cooling during the extrusion process as well as leading to uneven material flow through the extrusion die, all of which tends to cause twisting and warping within the extrusion, which must be minimized to the greatest extent possible during the manufacturing process for maximizing production efficiency and minimizing production costs by minimizing waste or spoilage. Moreover, the profile of Claesson results in overlapped side joints, which complicates assembly by requiring careful joining of the two profiles, as well as increased weight, and thus material costs, in the construction of the "profile."

What is needed, therefore, is a one-piece extrusion which can be used to construct an elongate deck plank, and which can be easily and quickly installed in the field for constructing the deck or dock with which the extrusion is being used. What is also needed, but seemingly unavailable in the art, is the provision of a one-piece extrusion which can accomplish this task, yet which can be manufactured of recycled plastic for the purposes of reducing manufacturing costs, and also for benefiting the environment by recycling waste plastics commonly used in consumer and commercial applications and supplies of which are readily available. An additional need is for a one-piece extrusion which will not require a second extrusion which must first be placed in position, and to which a second different extrusion must be fit in order to construct a deck or dock, as well as minimizing both manufacturers', distributors', and contractors' inventory by requiring that only a single style of a one-piece extrusion be maintained in inventory, as opposed to differing extrusions of differing design. Moreover, there is a need for such an extrusion which can be made of either a virgin or recycled plastic, or even a combination of the two.

SUMMARY OF THE INVENTION

The present invention provides an improved decking extrusion which overcomes a number of the design deficiencies of other decking extrusions known in the art, and which represents a significant advance in the art. The improved decking extrusion of this invention provides a highly adaptable extrusion which is relatively simple to manufacture, offers improved performance characteristics over other extrusions known in the art, and which can be used with a second identical extrusion to form an elongate box beam, or a deck plank, in order to quickly, easily, and safely erect deck and dock structures. Moreover, the decking extrusion of this invention can be extruded of either a virgin or a recycled plastic material, or may even be extruded of a virgin plastic exterior shell and a recycled plastic core, all of which addresses environmental concerns regarding the recycling of synthetic materials, namely plastics, and also offers reduced cost in the manufacture of the extrusion.

The improved decking extrusion of this invention can be matched to the needs of manufacturers, distributors, and contractors by providing a single style or design of the product to be manufactured, warehoused, distributed and used in the construction of decks and docks. The improved extrusion of this invention can be easily packaged and shipped, and may be quickly and easily used to construct a deck or dock. This invention therefore provides a novel decking extrusion which is well-suited for use in a large variety of applications, and which can easily be retrofit to existing deck and dock structures when replacing dimensional lumber components.

This invention attains this high degree of flexibility, and simplicity, by providing in the first instance an extrusion having an elongate base panel with a first side edge and a spaced parallel second side edge, with at least a first elongate leg member extending the length of the base panel along the first side edge, and a second spaced parallel leg member extending the length of the base panel along its second side edge. The leg members extend away from the base panel in a common parallel direction, and are generally perpendicular to the base panel. Both of the leg members extend the entire length of the base panel, from its front to its rear edges. Moreover, a first locking element is formed at the distal end of the first leg member, and a complimentary second locking element is formed at the distal end of the second leg member, and is sized and shaped to resiliently receive a second one of the first locking elements therein in an interlocked snap-fit.

This is accomplished by taking a second identical extrusion, and placing it above the first extrusion in a 180° reverse relationship with respect to the first extrusion, and then moving the second extrusion downwardly straight onto the first extrusion to snap the two extrusions together, thus quickly and easily forming an elongate decking member in response thereto. This is accomplished by passing the first locking element and the second locking element, respectively, of a second decking extrusion over a second locking element and a first locking element, respectively, of the first decking extrusion so that the locking elements move into the interlocked snap-fit, which locks the two extrusions together along the length of their opposed side edges to form a rigid, load bearing. Structural deck plank.

The decking extrusion may be formed of a virgin, or a recycled plastic, or may even be formed with a virgin plastic exterior shell and an interior recycled plastic core. Also, and if so desired, a resilient thin gauge metal could be used, although the extrusions will be comprised of plastic in its preferred embodiments. In addition, the extrusion, in a number of its embodiments, has a uniform cross-section to help ensure uniformity in the extrusion during the extrusion process, as well as allowing for uniformity in the cooling of the extrusion to avoid any twisting or warping in the extrusion during cooling after the extruding, process.

In a first embodiment, the extrusion will include a pair of first leg members which are spaced and parallel from one another, and a pair of spaced and parallel second leg members, extending the length of the extrusion. The first locking elements of the pair of first leg members are constructed and arranged to be resiliently urged away from one another, and the second locking elements of the pair of second leg members are constructed and arranged to be resiliently urged toward one another as a second locking element, and first locking element, respectively, of a second identical decking extrusion placed in a 180° reverse relationship with respect to the first extrusion are slidably engaged therewith, and passed thereover to lock the two extrusions together.

In another embodiment, the second locking elements will comprise an additional minor leg member which is constructed and arranged to yield to the passage of a first locking element passed thereover, and to be biased back into an extended position to lock the first element in the snap fit while mating the two extrusions together.

In yet another embodiment, an elongate stiffening leg, extending the length of the base panel, and spaced intermediate the first and second leg members, may be provided, having a flange formed at the distal end thereof which is parallel to the base panel for mating with a second identical stiffening leg, and flange, of a second extrusion for additional structural rigidity to the extrusions when mated together as a deck plank or box beam.

In still another embodiment, the extrusion is provided with a pair of spaced first legs, and a single second leg member, the single second leg member having a raised tab constructed and arranged to be passed between opposed minor leg members extending from the first leg members and into an interlocked snap fit for locking two extrusions together upon one another.

Also, it is anticipated that in yet another embodiment the first locking element will be an elongate slot extending the length of the base panel, and the second locking element will be a raised tab sized and shaped to be received within the slot, such that when two identical extrusions are placed in a 180° reverse relationship with respect to one another, the respective tabs can be received within the respective slots for locking the two extrusions together quickly and easily into an elongate decking plank or decking member. Several alternative slot and tab arrangements are also provided.

As an additional feature, the exterior surface of the base panel may have a non-skid pattern extruded therein as a part of the process of extruding the decking extrusion without the need to separately emboss a non-skid pattern or textured surface on the exterior surface of the respective extrusions.

It is, therefore, an object of the present invention to provide an improved decking extrusion which is simple in design, easy to manufacture, and easy to assemble into a decking member for use in the construction of deck and dock-type structures.

It is another object of the present invention to provide an improved decking extrusion which has a uniform cross-section for minimizing any warp or twist in the extrusion as it cools after extrusion.

Yet another object of the present invention is to provide an improved decking extrusion which can be made of recycled plastic.

An additional object of the present invention is to provide an improved decking extrusion in which a single type of decking extrusion may be used with a second identical decking extrusion to form an elongate deck plank or deck member, without the need for a second separate extruded deck plank extrusion of a different design or construction.

Still another object of the present invention is to provide an improved decking extrusion which can be packaged conveniently for shipment and storage.

Thus, these and other objects, features, and advantages of the present invention will become apparent upon reading the specification when taken in conjunction with the accompanying drawings.

DETAILED DESCRIPTION OF THE PREFERRED EMBODIMENTS

Figure 1:
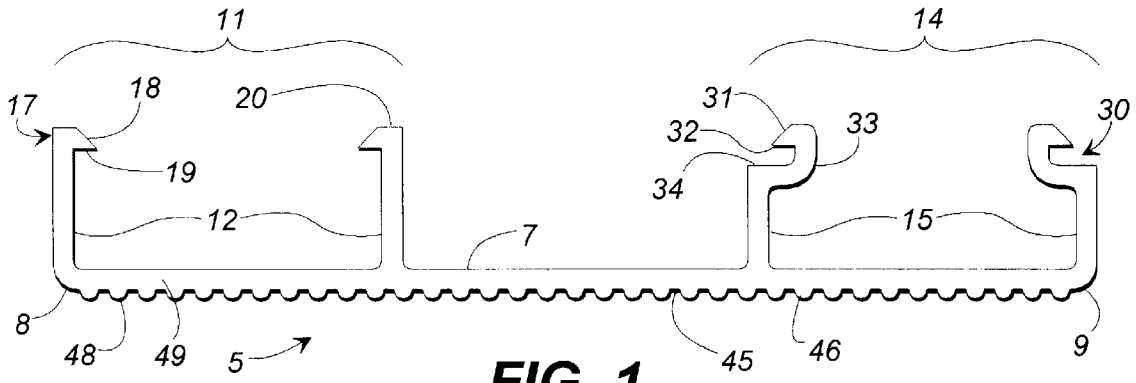
FIG. 1 is an end elevational view of a first embodiment of the decking extrusion of the present invention.

Referring now to the drawings in which like details are indicated by like reference numerals throughout the several views, FIG. 1 is an end elevational view of a first embodiment of the decking extrusion 5 of this invention. Decking extrusion 5 has an elongate planar base panel 7 having a first side edge 8, and a spaced parallel second side edge 9. As shown in FIG. 1, extending along the first side edge of the base panel is a pair 11 of first leg members 12, and extending along the second side edge of the base panel is a pair 14 of second leg members 15. The leg members within each pair of leg members are spaced from and parallel to one another, and the two pairs of leg members are also spaced from, and parallel to one another, and all the leg members extend the length of the base panel 7. Moreover, all the leg members extend in a common direction perpendicularly away from the base panel, such that the proximal end of each leg member is formed as a part of the base panel or side edges, respectively, and the distal end of each leg member extends away from the base panel.

Figure 2:
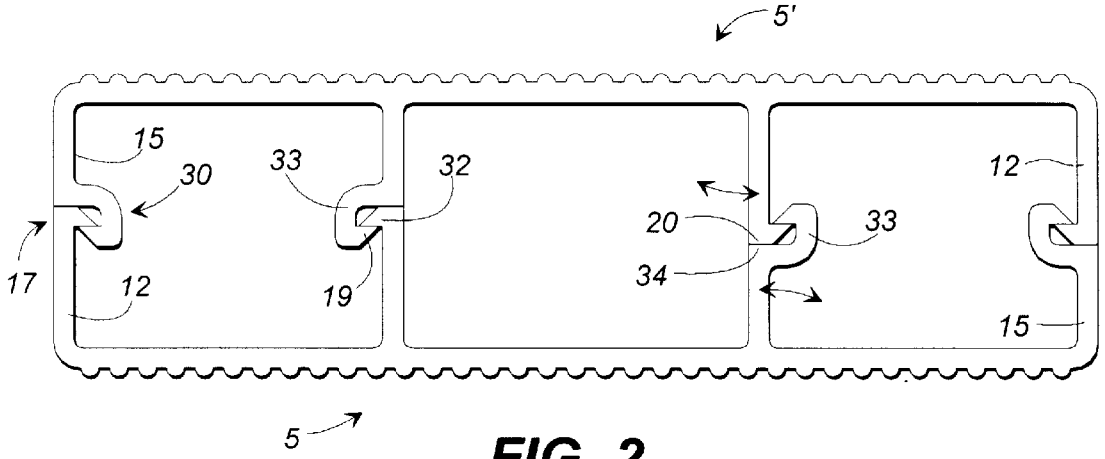
FIG. 2 is an end elevational view of two decking extrusions of the type illustrated in FIG. 1 joined together to form a deck plank.

Formed at the distal end of each first leg member 12 is a first locking element 17, formed as a part of the extrusion. Each first locking element 17 has an inclined surface 18 extending downwardly to a hook 19, or a hooked edge if so preferred, constructed and arranged to be received in an interlocked snap-fit with a complimentary second locking element 30, as best shown in FIG. 2. Still referring to FIG. 1, however, each first locking element 17 also includes a mating surface 20 which will be received upon a corresponding mating surface 34 formed as a part of the respective second locking elements 30.

Figure 3:
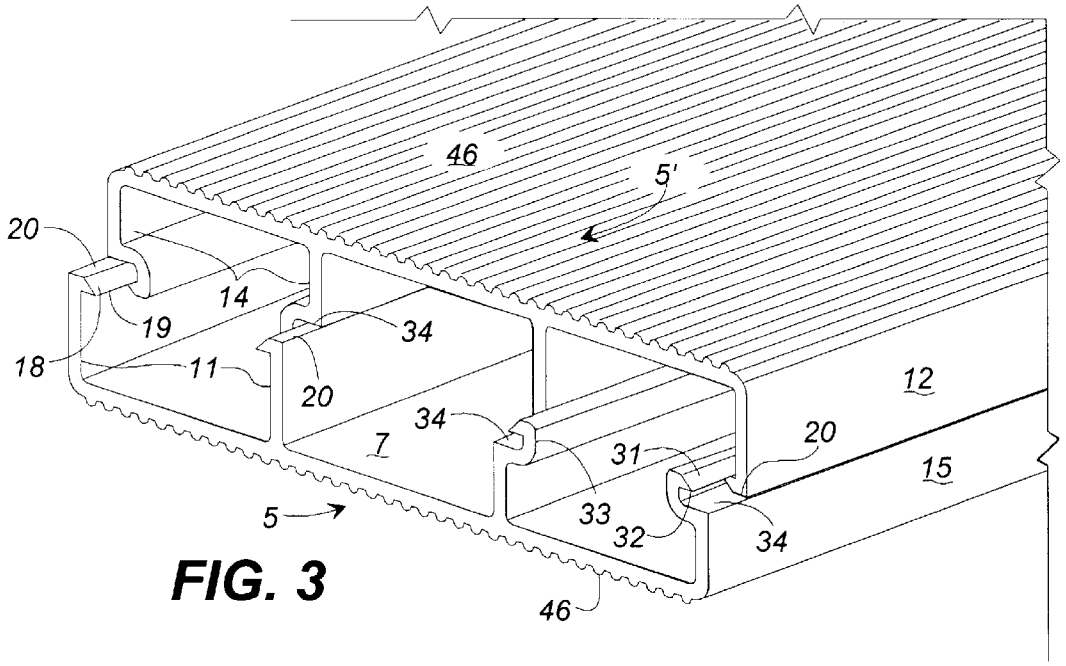
FIG. 3 is a partially cut away perspective view of the extrusions of FIG. 2 forming an elongate deck plank.

Referring to FIGS. 1 and 2, extrusion 5 also includes, therefore, a second locking element 30 having an inclined surface 31 of reverse hand to that of first locking element 17, extending to a hook, or hooked edge, 32 constructed and arranged to engage the hook 19 of each first locking element 17, as best shown in FIGS. 2 and 3. Unlike each of first locking elements 17, though, the inclined surface and hook of each second locking element 30 extends from an elongate throat 33, the throat being sized and shaped to receive the inclined surface and hook of the first locking element 17 snugly therein so that the first locking element will be able to be easily snapped into the respective second locking element with which it is being mated and held thereby in an interlocked snap-fit.

As shown in FIGS. 2 and 3, a first decking extrusion 5, and a second identical decking extrusion 5', decking extrusion 5' being placed in a 180° reverse relationship with respect to decking extrusion 5, have been mated together to form an elongate deck plank for use in constructing outdoor decks and docks. As shown in FIGS. 2 and 3, therefore, the respective hooks 19, 32, of locking elements 17, 30, respectively, are interlocked with one another, and mating surface 20 of first locking element 17 is received on a corresponding mating surface 34 of second locking element 30, such that when the two extrusions are mated together, they form a substantially rigid load-bearing elongate box beam structural component for use as a deck plank, although being extruded of plastic it offers the advantage of improved service life at a lighter weight over that of dimensional lumber.

As shown in FIG. 1, base panel 7 of decking extrusion 5 has an exterior surface 45. Extruded as a part of the exterior surface of the extrusions 5, 5' of FIGS. 2 and 3 is a non-skid pattern 46, best illustrated in FIG. 3, which allows for water drainage and to help prevent people from slipping when walking on a wet deck or dock. Unlike some of the prior art extrusions, for example the '045 patent to Yoder, non-skid pattern 46 is extruded as a part of the extrusion, and is not otherwise embossed, or formed in the exterior surface of the extrusion after it has been extruded, or added as a second extrusion to the first. This offers the advantages of using the same material for both the extrusion and its non-skid pattern, and allows for a lower production cost in so forming the extrusion. This non-skid pattern may be omitted if so desired, as shown in FIGS. 4–11C, or may be extruded, all as desired by the end user. Although not illustrated herein, it is anticipated that an artificial wood grain pattern could be hot embossed on exterior surface 45 if desired to more closely resemble the appearance of traditional lumber decking if so desired.

As shown in FIG. 1, decking extrusion 5 is formed of an extruded plastic material. It is anticipated that the decking extrusion can be formed of a first plastic material 48 forming the exterior shell of the extrusion, and a second plastic material 49 forming the interior core of the extrusion. This may occur with all of the embodiments of the invention as shown in FIGS. 1–11C. If extrusion 5 and its counterparts in FIGS. 4–11C are formed of two plastic materials, it is anticipated that the first plastic material will be a virgin plastic material, and the second plastic material, while also the same type of plastic material as the first material, will be a recycled plastic material thus reducing the cost of the extruded product. However, it is anticipated that extrusion 5, in each of its embodiments shown in FIGS. 1–11C, will be extruded of a single plastic material, be it either a virgin or a recycled plastic material. It is anticipated that extrusion 5 will be extruded from recycled polyvinylchloride ("PVC"). However, the decking extrusion of this invention can be extruded equally as well from virgin PVC, virgin or recycled polyethylene, and could also be pull-truded fiberglass, which, as known to those of skill in the art, comprises oriented fiberglass strands within a resin base used in lieu of a plastic. However, due to the combination of cost, and strength, it is preferred that extrusion 5 will be made of either recycled or virgin PVC.

Figure 4A:
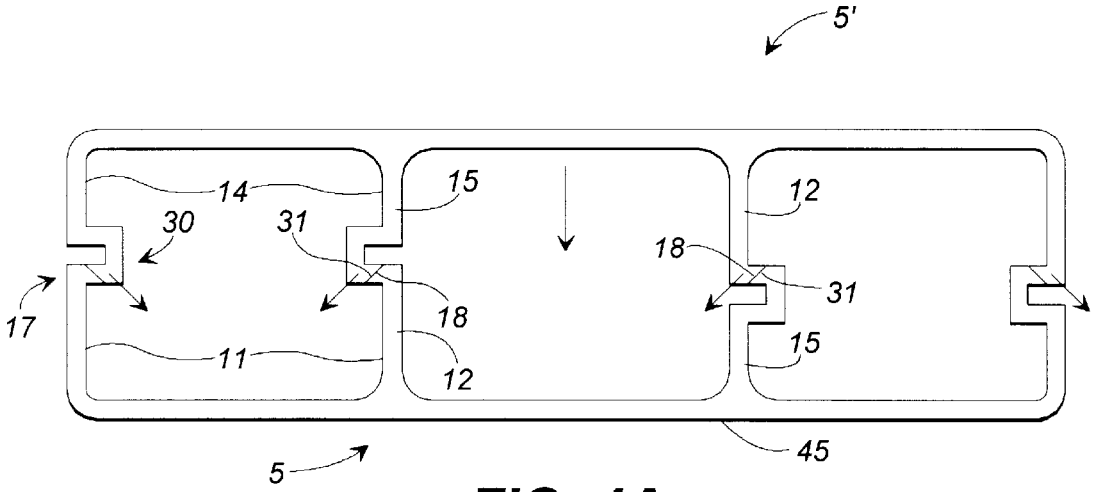
FIG. 4A is an end elevational view of a second embodiment of the decking extrusions illustrated in FIGS. 1 and 2 showing how the two extrusions are joined together to form an elongate deck plank.
Figure 4B:
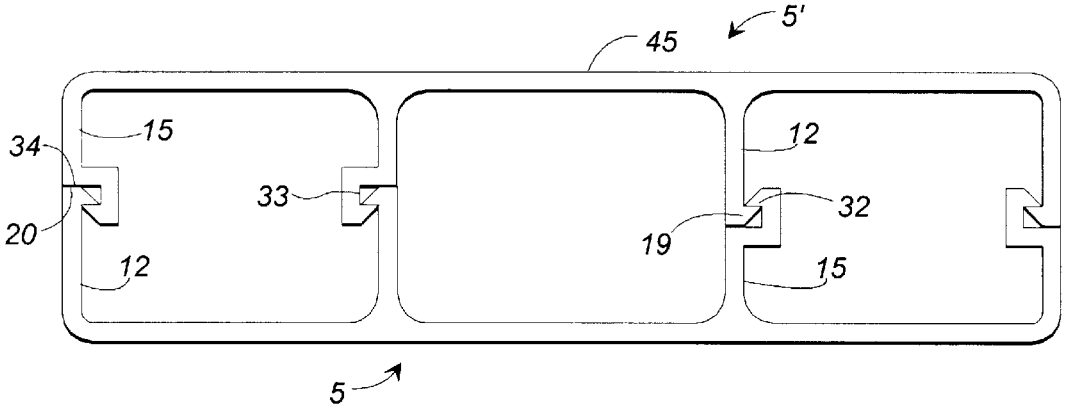
FIG. 4B is an end elevational view of the extrusions illustrated in FIG. 4A joined together to form a deck plank.
Figure 5:
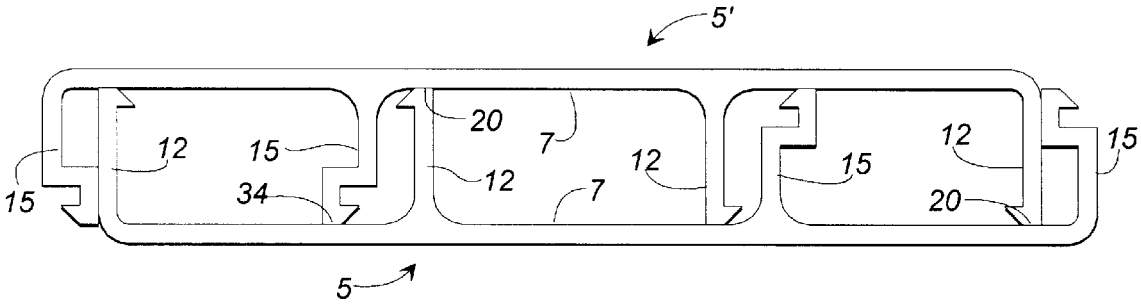
FIG. 5 is an end elevational view of the extrusions illustrated in FIGS. 4A and B, showing the manner in which the extrusions may be packaged for shipment and storage.

A second embodiment of extrusion 5 is illustrated in FIGS. 4A–5, the only significant difference being that extrusion 5 of FIGS. 4A–5 does not have a non-skid pattern 46 extruded as a part of the exterior surface 45 thereof. As shown in FIG. 4A, a first extrusion 5 is being mated to a second identical extrusion 5' placed in a 180° reverse relationship with respect to the first extrusion. So oriented, each first locking element 17 is positioned with respect to, and received by a complimentary second locking element 30 in both of the pairs of leg members. As positioned in FIG. 4A, therefore, the inclined surfaces 18 of each first locking element 17 are received on the complimentary and reverse hand inclined surfaces 31 of each second locking element 30. As the second extrusion 5' is moved downwardly on the first extrusion 5, the leg members 12 of the pair 11 of first leg members will be resiliently urged outwardly and away from one another, while at the same time the leg members 15 of the pair 14 of second leg members are resiliently urged inward toward one another such that, as shown in FIGS. 2 and 4B, once the second extrusion 5' has been mated with the first extrusion 5, the respective leg members 12, 15 move or spring back to their respective original positions and form the interlocked snap-fit of the first locking elements 17 with respect to second locking elements 30 of the two extrusions.

Thus, rather than taking a first extrusion and moving it lengthwise end first along the entire length of a second extrusion to join the two locking elements/extrusions together, the novel decking extrusion of this invention may be used to form deck planks for use in constructing decks or docks by placing a second identical extrusion above a first extrusion, and passing the first extrusion downwardly onto the first extrusion until the locking elements have snapped together. Moreover, due to the resilient nature of the leg members 12, 15, and of the locking elements 17, 30, respectively, the two extrusions are mated together in a resilient snap-fit such that they are not likely to pull apart accidentally or in unintended fashion, yet which can be disassembled when, and if desired, by prying the locking elements apart from one another at one of the ends of the mated decking extrusions, then lifting the top decking extrusion upwardly and away from the bottom decking extrusion moving from the front to rear edges of the extrusions, or vice versa, for example.

An additional feature of the decking extrusion of this invention is that it can be nested for shipment and storage, as shown in FIG. 5, in which the mating surfaces 20, 34, of the respective locking elements are received against the respective base panels 7 of each of the two extrusions. So collapsed for storage and shipment, the extrusions support one another, yet can be sandwiched atop one another in layers of any desired height, and then bundled, as desired, for ease of shipment and handling, as well as minimizing the amount of storage space required for the completed extrusion. This is of great importance to distributors, as well as to contractors, who constantly strive to maximize the use of their storage space for reducing overhead. Moreover, once a pair of sandwiched extrusions are removed from a package of extrusions, they can be left sandwiched until such time as the contractor wishes to mate them together, whereupon the process of FIGS. 4A and B will be repeated for each deck plank so formed and used to construct the appropriate deck or dock with which the extrusions are being used.

Figure 6A:
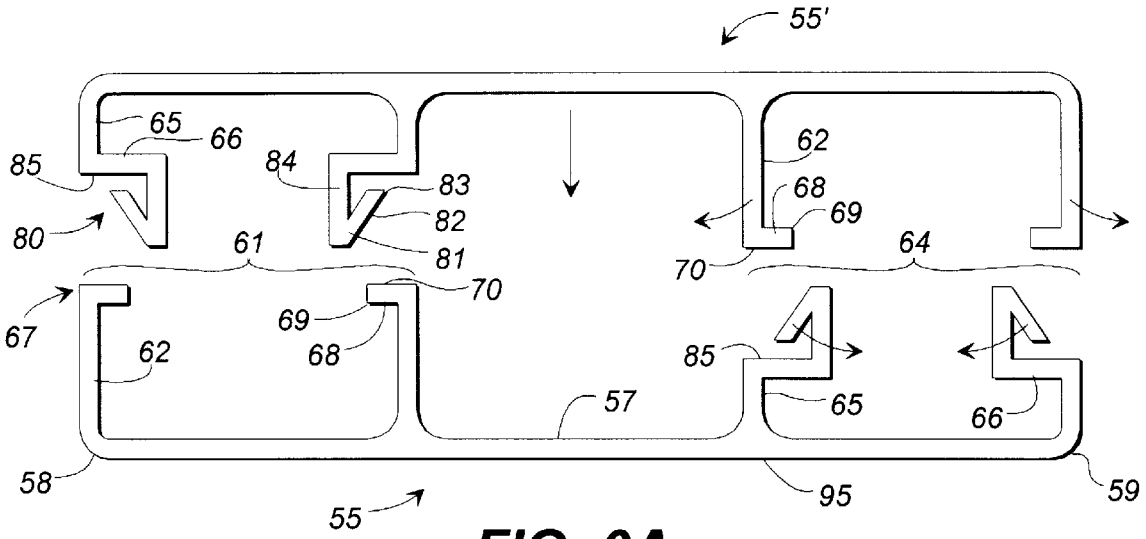
FIG. 6A is an end elevational view of a third embodiment of the decking extrusion of this invention showing a second decking extrusion positioned in a 180° reverse relationship with respect to a first decking extrusion prior to joining the two extrusions together.
Figure 6B:
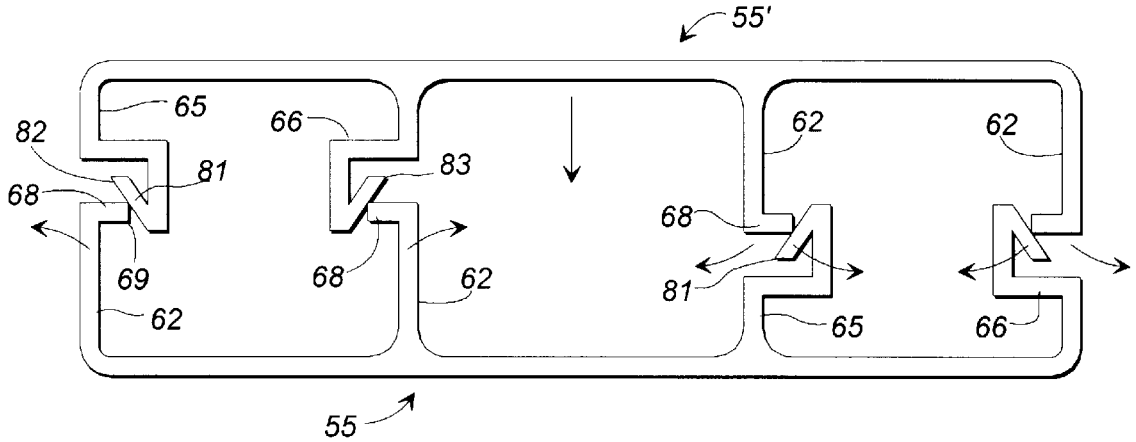
FIG. 6B is an end elevational view of the extrusions of FIG. 6A being joined together to form a deck plank.
Figure 6C:
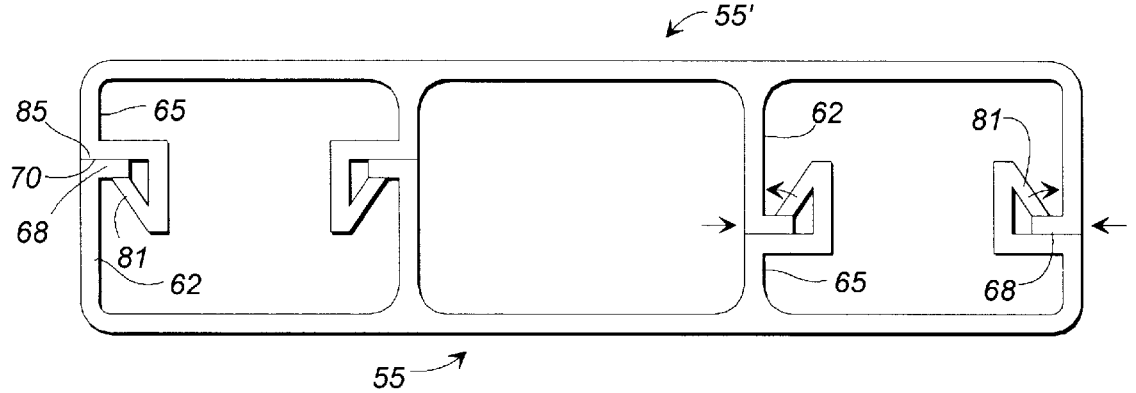
FIG. 6C is an end elevational view of the two extrusions illustrated in FIG. 6A joined together to form the deck plank.

Referring to FIGS. 6A–6C now, a third embodiment of the decking extrusion of this invention is illustrated. Turning first to FIG. 6A, a first extrusion 55, and a second identical extrusion 55' are illustrated in a 180° reverse relationship with respect to one another. Each extrusion 55, 55' has an elongate base panel 57 having a first side edge 58. and an opposed second side edge 59. Formed along the first side edge is a pair 61 of first leg member 62, and formed along second side edge 59 is a pair 64 of second leg members 65. Here. unlike the decking extrusions of FIGS. 1–5, the second leg member has a stepped section 66 formed perpendicularly with respect to the height of the leg member above the base panel, and on which the respective second locking elements 80 of the extrusion are formed.

Each one of first leg members 62 includes a first locking element 67 formed at its distal end. Each locking element includes a minor leg member 68, the two minor leg members being opposed from and facing one another, each minor leg member forming a hook 69 at the distal end of the respective first leg members. Each first leg member 62 also includes a mating surface 70 formed at its distal end for being received on a corresponding mating surface 85 of the second leg members 65.

Second locking element 80 formed at the distal end of each second leg members 65 includes a minor leg member 81 which extends downwardly at an angle from the distal end of the leg member. So extruded, minor leg member 81 is normally biased into an extended position as shown in FIGS. 6A and B, yet is constructed and arranged to resiliently yield to the passage of a first locking element 17 thereover, whereupon the minor leg member then is resiliently urged back into its extended position, as shown in FIG. 6C, for locking the first elements 67 therein.

In fashion similar to the second locking elements of FIGS. 1–5, second locking element 80 includes an inclined surface 82 formed as a part of minor leg 81, the minor leg member forming a hook 83 at the downwardly extending edge thereof and being supported above the stepped sections 66 of each second leg member 65 by an elongate throat 84, and including a mating surface 85 for receiving the mating surface 70 of a first leg member 62.

The method by which extrusions 55 and 55' are mated together to form an elongate deck member is illustrated in FIGS. 6A–C. Second extrusion 55 is placed in a 180° reverse relationship with respect to extrusion 55, such that the second leg members 65 of the second pair 64 of leg members of extrusion 55' are positioned above the first leg members 62 of the first pair 61 of leg members of extrusion 55, and so that the first leg members 62 of extrusion 55' are positioned above the second leg members 65 of extrusion 55. Thereafter, as shown in FIG. 6B, extrusion 55' is moved downwardly toward and into engagement with extrusion 55, such that the minor leg members 81 of the second locking elements 80 of each extrusion respectively, are resiliently urged inwardly toward the throat 84 of the second locking element by the hook 69 formed by minor leg members 68 of first locking element 67. The first leg members 62 will tend to be urged outwardly away from one another, while the second leg members 65 will tend to be urged inwardly toward one another during this process. Thereafter, once minor leg members 68 have cleared the end of inclined surface 82 of each minor leg member 81, minor leg members 81 are resiliently urged back into their extended position, as shown in FIG. 6C, for locking the first locking elements within the throat 84 of each second locking element 80 in an interlocked snap fit. The extrusion of FIGS. 6A–6C thus offer the feature of a more positive lock than is obtained with that of the extrusion of FIGS. 1–5.

Each of extrusions 5 and 55 of FIGS. 1–6C has a uniform cross-section. This is an important feature for extrusions in that by providing a uniform cross-section the extrusion will tend to cool at a uniform rate, which will tend to avoid bowing or warping in the extrusion, and also prevent any problems with thickness variations throughout the extrusion by allowing for a simpler construction of the die (not illustrated) tooled for forming the extrusion. Moreover, by having a uniform cross-section, or thickness, throughout the extrusion, problems in differential flows in the differing dies which would be required to form such an extrusion are avoided, which is especially important when dealing with recycled materials when the quality of the plastic material will not always be as high, nor as uniform in terms of flow rate or consistency, as a molten virgin plastic.

Each of extrusions 5, 55 of FIGS. 1–6C, as well as extrusions 105, 155 and 205 of FIGS. 7–10, are standard continuous extrusions made in the manner known to those skilled in the art. Each of extrusions 5, 55, 105, 155, and 205 will be made of a plastic material, preferably a recycled PVC, as discussed in greater detail hereinabove. It is also anticipated, as discussed hereinabove, that if so desired, a virgin plastic exterior may be used. with a recycled plastic core for the extrusions so formed. Also, although not illustrated specifically in FIGS. 1–10, it is anticipated that a dye can be added to the plastic for attaining a desired architectural appearance, i.e., color, and which thus dispenses with the need to otherwise paint or stain the decking members.

Figure 7:
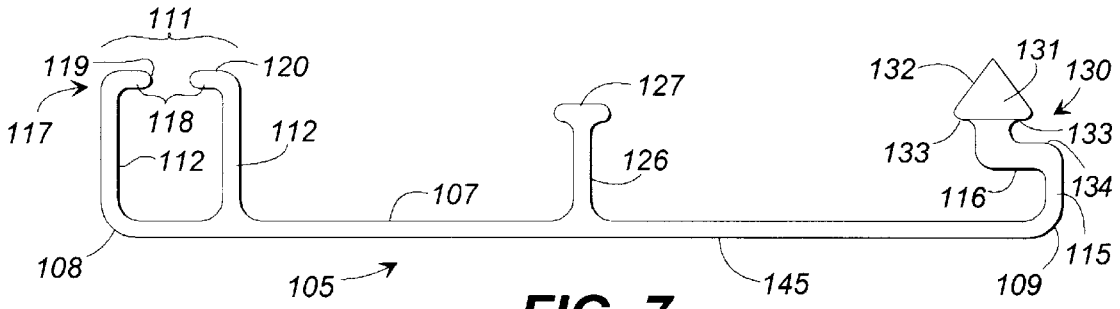
FIG. 7 is an end elevational view of a fourth embodiment of the decking extrusion of this invention.
Figure 8:
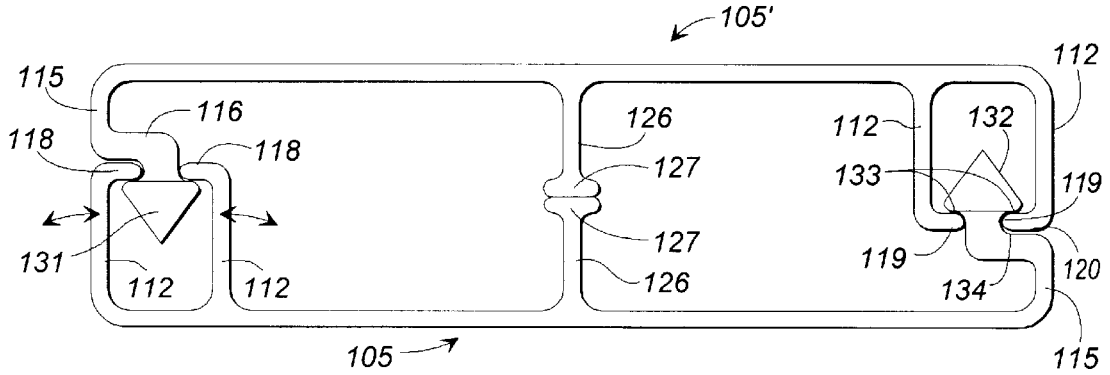
FIG. 8 is an end elevational view of two of the decking extrusions of FIG. 7 joined together to form a deck plank.

A fourth embodiment of the decking extrusion of this invention is illustrated in FIGS. 7 and 8. In FIG. 7, an extrusion 105 is provided having an elongate base panel 107, with a first elongate side edge 108, and a second opposed parallel side edge 109. Formed along first side edge 108 is a pair 111 of first leg members 112 extending the length of base panel 107. A locking element 117 is formed at the distal end of each leg member 112, and is comprised of a minor leg member 118 extending transversely with respect to the length of leg member 112, forming a hook 119. The two opposed minor leg members 118 also define an elongate slot therebetween which extends the length of base panel 107. Also, and as provided in the embodiments of the invention shown in FIGS. 1–6C, a mating surface 120 is provided as part of each leg member 112.

In this embodiment, however, unlike the earlier embodiments of the invention, an elongate stiffening leg member 126 is also provided as a part of the extrusion, which extends from the front (not illustrated) to the rear (not illustrated) edges of the extrusion, i.e. extending the length of base panel 107. Stiffening leg member 126 includes an elongate transverse flange 127 formed as a part thereof, the surface of flange 127 being perpendicular to the stiffening leg member 126, such that it may receive a second complimentary flange 127 of the stiffening leg member 126 of a second identical decking extrusion 105', as shown in FIG. 8. Stiffening leg member 126 is provided for adding structural rigidity to the deck plank formed by the extrusions when mated together.

Formed along the second side edge 109 of extrusion 105 of FIGS. 7 and 8 is a single elongate second leg member 115, spaced from and parallel to each of leg members 112, as well as being spaced from stiffening leg member 126. Second leg member 115 includes a stepped section 116 which extends perpendicularly with respect to the height of the leg member above base panel 107, and has second locking element 130 formed at the distal end thereof. Here, unlike the earlier embodiments of this invention, second locking element 130 comprises a raised tab 131 which is sized and shaped to be passed between the two opposed minor leg members 118 formed as a part of the first locking element 117. Here tab 131 is formed as a wedge shaped tab having a inclined surface 132 extending downwardly to an annular shoulder 133 formed by the tab. Second leg member 115 also includes a mating surface 134 for receiving the mating surface 120 of the outermost first leg member 112, i.e. that leg member extending along first side edge 108.

FIG. 8 illustrates the manner in which this embodiment of decking extrusion 105 will be mated together, in which a first decking extrusion 105, and a second identical decking extrusion 105' are mated to one another after first being placed in a 180° reverse relationship with respect to one another, and the tabs 131 of each second locking element 130 being passed yieldably between the minor leg members 118 of each first locking element 117 of each pair of first leg members 112. After tab 131 is passed between minor leg members 118, they are resiliently urged back into their original position such that hooks 119 are received within the annular shoulder 133 of the tab, with the mating surface 120 of the outermost first leg member being received against the mating surface 134 of the second leg member, and the flanges 127 of each of stiffening leg member 126 being received on each other, thus forming a deck plank.

The embodiment of extrusion 105 shown in FIGS. 7 and 8 offers the advantage of even quicker on-site assembly into deck planks than the embodiments of the invention shown in FIGS. 1–6C. However, although extrusion 105 has a generally uniform cross-section throughout its entirety, the cross-section of the extrusion at stepped section 116 and tab 131 is thicker than the remainder of the extrusion. The thickness of this cross-section allows for greater load bearing capabilities sufficient to allow the outermost leg member 112 to be received thereon and to transmit its load through surface 120 onto the mating surface 134 of second leg member 115.

Figure 9:
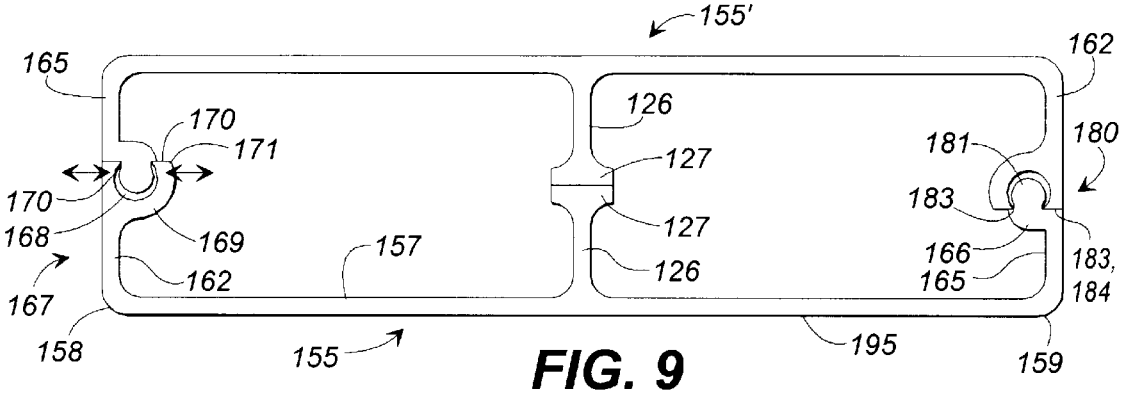
FIG. 9 is an end elevational view of two identical extrusions of a fifth embodiment of the invention joined together to form a deck plank.

A fifth embodiment of the extrusion of this invention is illustrated in FIG. 9. Here a first extrusion 155 and a second identical extrusion 155 are shown mated together. In fashion similar to the other embodiments of this invention, extrusion 155 includes an elongate planar base panel 157 having a first side edge 158, and an opposed parallel second side edge 159 extending the length of the base panel. A first leg member 162 is formed and extends along the length of the first side edge of the base panel, and a spaced parallel second leg member 165 is formed and extends along the length of the second side edge of the base panel. Second leg member 165, in fashion similar to the embodiment of the invention illustrated in FIG. 7A, has a stepped section 166 which steps the leg member inwardly of the outside second edge 159 of base panel 157.

First leg member 162 includes a first locking element 167 having an elongate slot 168 formed by a minor leg member 169 extending upwardly from the first leg member 162. In the embodiment shown in FIG. 9, minor leg member 169 has an arcuate configuration, such that an arcuate or rounded slot 168 in cross-section is formed which extends the length of base panel 157. Slot 168 is defined by the opposed side edges 170, or by analogy, the hooks of first leg member 162 and minor leg member 169. A pair of parallel mating surfaces 171 are formed on first leg member 162 and minor leg member 169, respectively.

A stiffening leg member 176 is positioned intermediate the first and second leg members of extrusion 155, and has a flange 177 which extends transversely with respect to the stiffening leg member, for being mated with a second flange 177 of extrusion 155', as shown in FIG. 9.

A second locking element 180 is formed at the distal end of second leg member 165. Formed at the end of the stepped section 166 of the second leg member therefore is a raised tab 181, which in this instance is a rounded tab sized and shaped to fit within the slot 168 formed by first locking element 167. Tab 181 has a pair of opposed shoulders 183, forming mating surfaces 184, for being received on mating surfaces 171 of first locking element 167, and as shown in FIG. 9.

When the extrusions 155, 155' are being mated together, minor leg member 169 will tend to move outwardly and away from the distal end of first leg member 162 until such time as the tab 181 is passed therethrough, whereupon the distal end of the first leg member, and the minor leg member will tend to be resiliently urged toward one another, such that the side edges 170 become engaged with the shoulders 183 of the tab, and mating surfaces 171 are received on mating surfaces 184, respectively.

Figure 10:
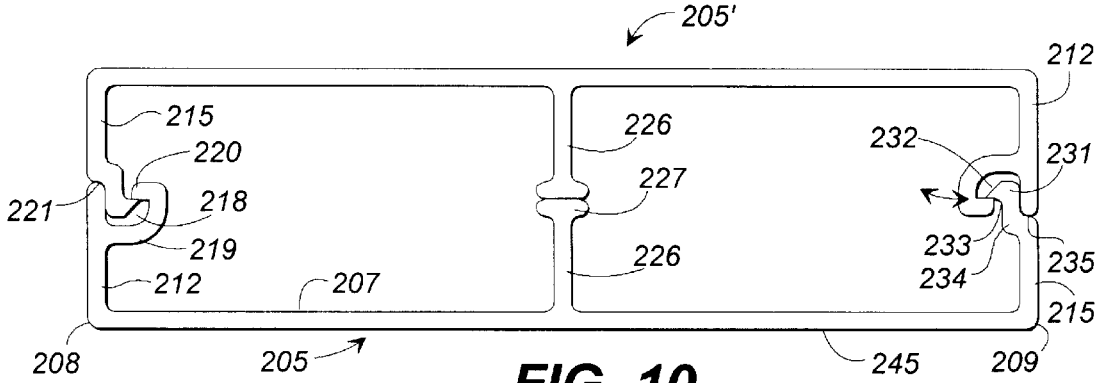
FIG. 10 is an end elevational view of two identical extrusions of a sixth embodiment of the invention joined together to form a deck plank.

A sixth embodiment of the extrusion of this invention is illustrated in FIG. 10, in which a first extrusion 205, and an identical second extrusion 205' are illustrated. Extrusion 205 once again includes an elongate planar base panel 207, with a first side edge 208, and an opposed parallel second side edge 209. A single first leg member 212 extends perpendicularly away from base panel 207, and a second leg member 215 also extends perpendicularly away from the base panel, and extends in a direction common to that in which first leg member 212 extends. Leg member 215 once again includes a stepped section, or throat 234 at second locking element 230.

First locking element 217 of extrusion 205 is defined by a slot 218 extending the length of the side edge, formed by a minor leg member 219 formed into a hook 220, which is spaced from the distal end of first leg member 212. In fashion similar to minor leg member 169 of FIG. 9, minor leg member 219 has an arcuate configuration in cross-section such that it may be moved away from the first leg member, yet will be resiliently urged back toward the first leg member for holding the raised tab 231 of second locking element 230 therein. A mating surface 221 is provided as a part of first leg member 212. Also, and as with the embodiment of the invention shown in FIGS. 7–9, an elongate stiffening leg 226 is provided intermediate the first and second leg members, having a transverse flange 227 for receiving the flange of the stiffening leg member of the second extrusion 205' thereon.

Second locking element 230 of FIG. 10 includes a raised tab 231 of a differing configuration than that of FIG. 9. As such, tab 231 has an inclined surface 232 extending downwardly to a hook 233 sized and shaped to be passed into and through slot 218 by urging minor leg member 219, and in particular hook 220, away from first leg member 212 until such time as the hook 233 passes underneath the hook 220 of the minor leg member, whereupon the minor leg member is resiliently urged back into its original position for locking the tabs within the respective slots. Second leg member 215 has a mating surface 235 sized and shaped to receive the mating surface 221 of first leg member 212, thereon. as shown in FIG. 10. The advantage of the embodiment of FIG. 10 over that of FIGS. 7–9, is that the extrusion 205 of FIG. 10 has a uniform cross-section, yet also allows for quick and easy fastening of extrusion 205' to extrusion 205 in the field.

Figure 11C:
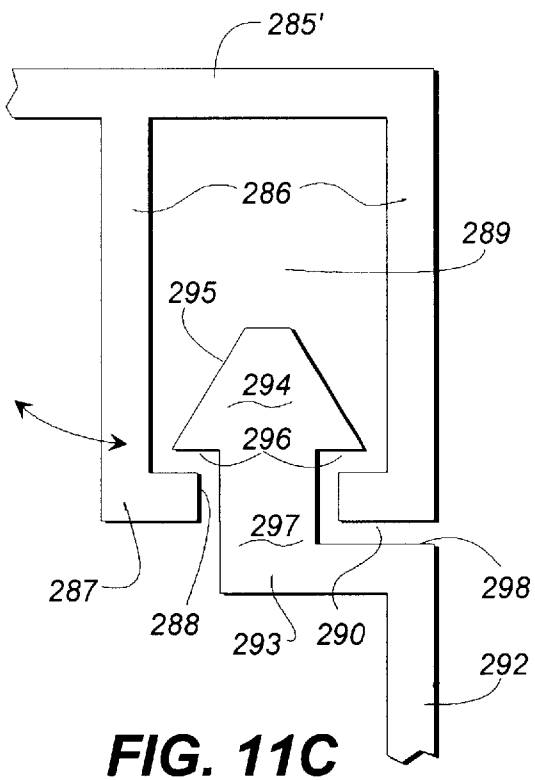
FIGS. 11A–11C illustrate three different embodiments of the manner in which the decking extrusions of this invention may be joined together along their respective side edges to form a deck plank.
Figure 11B:
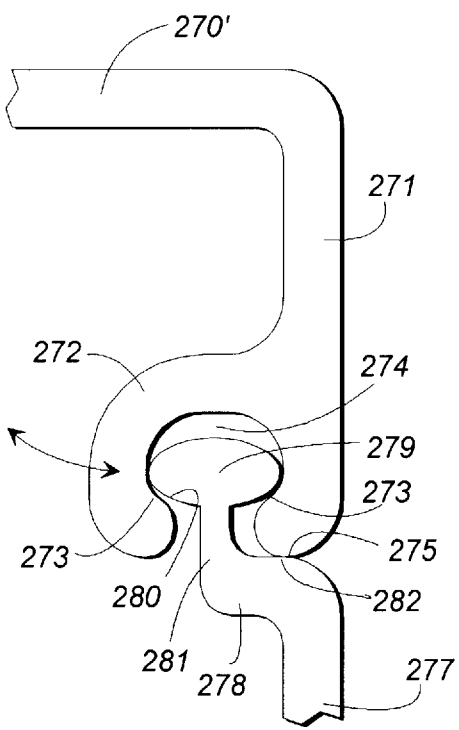
Figure 11A:
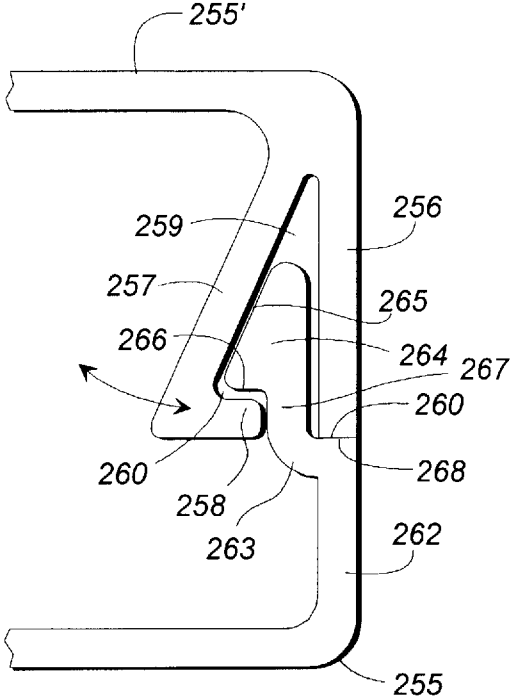

Three alternate embodiments of first and second locking elements constructed as slots and tabs, respectively, are illustrated in FIGS. 11A–11C, each of which may be used with extrusions 105, 155, and 205, of FIGS. 7–10, for example. Although only partial views of the extrusions are shown in FIGS. 11A–11C, it is anticipated that each of the two extrusions which comprise the deck plank when mated together, as shown in these Figures, will be identical extrusions placed in a 180° reverse relationship with respect to one another for mating the two extrusions together.

Accordingly, and as shown in FIG. 11A, an extrusion 255' is shown with a first leg member 256 and a second resilient minor leg member 257 extending therefrom and forming a hook 258. Hook 258 forms a slot 259 between the minor leg member 257 and the first leg member 256. First leg member 256 has a mating surface 260. Second leg member 262 has a stepped section 263 on which a raised tab 264 is formed. Tab 264 has an inclined surface 265 extending downwardly to a shoulder or hook 266, with a throat 267 extending downwardly from the shoulder. Mating surface 268 is provided as a part of the second leg member. Tab 264 is passed through slot 259 resiliently forcing hook 258 outwardly and away from leg member 256 until such time as hook 266 is passed over hook 258, whereupon the tab becomes locked within slot 259, and mating surfaces 260, 268 of the first and second leg members, respectively, are in engagement with one another. Tab 264 of FIG. 11A is constructed in the same fashion as is tab 231 of FIG. 10.

FIG. 11B discloses yet another embodiment of the first and second locking elements which may be used with the several embodiments of the decking extrusion of this invention. A second extrusion 270' having a first leg member 271 is shown, from which an arcuate or rounded minor leg member 272, constructed in fashion similar to that of minor leg member 169 of FIG. 9, extends. Minor leg member 272 has an internal shoulder 273 which, in conjunction with the distal end of first leg member 271 having a corresponding shoulder 273, forms an elongate slot 274 extending the length of the extrusion. First leg member 271 includes a mating surface 275 formed at its distal end.

Second leg member 277 once again has a stepped section 278 on which a raised tab, in this instance, an oval tab 279 is formed. Tab 279 has a pair of opposed shoulders 280 sized and shaped to be receive on the shoulders 273 of the minor and first leg member in an interlocked snap-fit relationship. As shown in FIG. 11B, mating surface 282 of second leg member 277 is received against mating surface 275 of first leg member 271 for adding structural rigidity and load bearing capacity to the mated extrusions.

Yet another locking element arrangement is shown in FIG. 11C which discloses an extrusion 285' having a pair of spaced parallel leg members 286, from which a pair of opposed minor leg members 287 extend facing one another, forming hooks 288 which define an elongate slot 289 extending the length of the extrusion in fashion similar to leg members 112 of FIGS. 7 and 8. The outwardmost first leg member 286 has a mating surface 290 formed at its distal end.

Second leg member 292 has a stepped section 293, from which a raised tab 294 extends. Raised tab 294 is constructed in fashion similar to tab 131 of FIG. 7, although its construction differs slightly in terms of not having an edge, nor rounded shoulders. Tab 294, however, has a sloped surface 295 extending downwardly toward a pair of spaced shoulders 296, with a throat 297 extending downwardly therefrom to stepped section 293 of the second leg member. A mating surface 298 is formed on the distal end of second leg member 292. Tab 294 is sized and shaped to urge the minor leg members 287 of the first pair of leg members 286 apart, until such time as it is passed therethrough, whereupon the resilient nature of the plastic extrusion will bias the minor leg members back toward one another, such that the hooks 288 will be positioned underneath shoulders 296 of the tab for locking the extrusions together. Mating surfaces 290 and 298 will be received against one another once the extrusions are joined together.

In constructing a deck or dock using the extrusions of this invention, a first extrusion 5, for example, as shown in FIG. 3, is placed on the support frame of a dock, for example. Each of leg members 12 and 15 extend upwardly, in a common parallel direction. A fastener, for instance a threaded fastener, is passed directly through base panel 7 and into the support frame of the dock. This is done on at least two spaced points along the support framework of the dock and the length of the extrusion, for example along two spaced and parallel stringers or joists forming a part of the dock framework, although only one joist is shown in FIG. 3. Thereafter, a second identical decking extrusion, 5' in this instance, is placed in a 180° reverse relationship with respect to, and above, extrusion 5. Then, in fashion shown in FIGS. 4A and B, the second extrusion is moved downwardly onto the first extrusion such that the first and second locking elements of the two extrusions engage one another, and are snapped into an interlocked snap-fit, which completes the formation of a first deck plank. So, constructed, the fasteners are housed within the completed deck member and thus sheltered from the environment. Thereafter, an extrusion 5 (not illustrated) of a second deck plank to be formed is positioned on the dock support spaced a desired distance from the now completed deck plank, and the process repeated until a sufficient number of deck planks have been formed to deck the surface of the dock. Although not illustrated, it is anticipated that an end cap sized and shaped to be snap-fit into the open, spaced ends of each plank may be provided for aesthetic purposes, if desired.

While preferred embodiments of the invention have been disclosed in the foregoing specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims, below, are intended to include any structure, material, or acts for performing the functions in combination with other claimed elements, as specifically claimed herein.

We claim:

1. A decking extrusion for connection to a duplicate inverted decking extrusion and forming a deck plank for use with outdoor deck and dock type structures, said decking extrusion comprising:

an elongate base panel having a first side edge and a spaced parallel second side edge;

a pair of spaced, parallel first leg members extending the length of said base panel along said first side edge; and a pair of spaced, parallel second leg members extending the length of said base panel along said second side edge;

said first and second leg members being spaced from and parallel to one another, each said leg member having a distal end extending in a common and generally perpendicular direction away from said base panel;

said first leg members each including at its said distal end a first locking element, with said first locking elements facing inwardly toward each other, and said second leg members each including at its said distal end a second locking element, with said second locking elements facing outwardly away from each other, said second locking elements each being sized and shaped to resiliently receive one of said first locking element of a duplicate decking extrusion in an interlocked snap-fit;

whereby a pair of duplicate decking extrusions are arranged with the first locking elements of each decking extrusion interlocked with the second locking elements of the other decking extrusion.

2. The decking extrusion of claim 1, wherein said first locking elements are each sized and shaped to be resiliently urged into said interlocked snap-fit with said second locking elements.

3. The decking extrusion of claim 1, wherein said first locking elements of said decking extrusion are resiliently urged into a snap fit with second locking elements of a second duplicate decking extrusion placed in a 180° reverse relationship with respect to said decking extrusion, and said second locking elements of the second duplicate decking extrusion, respectively, as the respective locking elements of said decking extrusion and of the second duplicate decking extrusion are slidingly passed across one another and moved into their respective interlocked snap-fits to mate the two extrusions together for forming the decking member.

4. The decking extrusion of claim 1, wherein said first locking elements are formed as male locking elements, and wherein said second locking elements are formed as female locking elements sized and shaped to receive said male locking elements therein.

5. The decking extrusion of claim 1, wherein said decking extrusion comprises a one-piece extrusion.

6. The decking extrusion of claim 5, wherein said decking extrusion is comprised of a recycled plastic core and a virgin plastic exterior.

7. The decking extrusion of claim 5, wherein said decking extrusion has a uniform thickness.

8. The decking extrusion of claim 5, wherein said decking extrusion is comprised of a plastic material, said plastic material being selected from one of the group of plastic materials consisting of polyvinylchloride or polyethylene.

9. The decking extrusion of claim 5, wherein said base panel has an exterior surface facing away from said leg members, and a non-skid pattern extruded as a part of said exterior surface.

10. The decking extrusion of claim 1, said decking extrusion comprising a one-piece extrusion comprised of a recycled plastic material.

11. The decking extrusion of claim 10, wherein said recycled plastic material is selected from one of the group of recyclable plastic materials consisting of polyvinylchloride or polyethylene.

12. The decking extrusion of claim 1, wherein the first locking elements of said pair of first leg members are constructed and arranged to be resiliently urged away from one another, and the second locking elements of said pair of second leg members are constructed and arranged to be resiliently urged toward one another as second locking elements and first locking elements, respectively, of a second identical decking extrusion are placed in a 180° reverse relationship with respect to said decking extrusion and are slidably engaged therewith and passed thereover into an interlocked snap-fit with one another, respectively, to mate the two extrusions together for forming the decking member.

13. The decking extrusion of claim 1, wherein said second locking element of each said leg member of said pair of second leg members comprising a resilient minor leg member, said minor leg member being biased into a normally extended position projecting away from and along the leg member.

14. The decking extrusion of claim 13, wherein each said minor leg member is constructed and arranged to yield to the passage of a first locking element of a second identical decking extrusion placed in a 180° reverse relationship with respect to said decking extrusion thereover, and to return to said extended position for locking the first locking element in a snap-fit therewith to mate the two extrusions together for forming the decking member.

15. The decking extrusion of claim 1, further comprising an elongate stiffening leg member spaced intermediate and parallel to said first and said second leg members, respectively, said stiffening leg member extending the length of said base panel and having a distal end extending in said common and generally perpendicular direction away from said base panel.

16. The decking extrusion of claim 15, further comprising a flange formed at the distal end of said stiffening leg member, said flange being parallel to said base panel.

17. The decking extrusion of claim 1, wherein the second locking element at the distal end of each said first leg member comprising a minor leg member extending away from its respective first leg member and facing inwardly toward the other one of said minor leg members, and wherein the first locking element at the distal end of said second leg member comprises a locking tab.

18. The decking extrusion of claim 17, wherein said locking tab comprises a wedge-shaped locking tab.

19. The decking extrusion of claim 17, wherein said locking tab is sized and shaped to resiliently urge the minor leg members of a second identical decking extrusion placed in a 180° reverse relationship with respect to said decking extrusion away from one another as said second locking element is passed therebetween and into a snap-fit for mating the two extrusions together to form the decking member.

20. The decking extrusion of claim 1, wherein said second locking element of each second leg member comprises an elongate tab receiving slot defined at the distal end of said second leg member and extending the length of said base panel, and said first locking element of each said first leg member comprises a raised locking tab defined at the distal end of said first leg member and extending from the length of said base panel.

21. A decking extrusion for use in constructing outdoor deck and dock type structures, two of said decking extrusions being mated together to form an elongate substantially hollow decking member, said decking extrusion comprising:

an elongate base panel having a first side edge and a spaced, parallel second side edge;

a pair of spaced, parallel first resilient leg members extending the length of said first side edge; and a pair of spaced, parallel second resilient leg members extending the length of said second side edge;

each of said leg members being spaced from and parallel to the others of said leg members, and having a distal end extending in a generally perpendicular and common direction away from said base panel;

said first leg members each having a first locking element formed at its distal end and said second leg members each having a second locking element complementary to one of said first locking elements formed at its respective distal end, said second locking elements each being sized and shaped to receive one of said first locking elements therein; and said first locking elements of said pair of first leg members being constructed and arranged to be resiliently urged away from each other, and said second locking elements of said pair of second leg members being constructed and arranged to be resiliently urged toward one another as said second locking elements and first locking elements of a duplicate decking extrusion in a reverse 180° reverse relationship with respect to said decking extrusion are engaged therewith and slidably passed thereover into interlocked snap-fit with one another to mate the two extrusions together for forming a decking member.

22. The decking extrusion of claim 21, wherein said first locking elements are each formed as a male locking element, and wherein said second locking elements are each formed as a female locking element sized and shaped to resiliently receive one of said male locking elements in an interlocked snap-fit.

23. A decking extrusion used to form a decking member for use with outdoor deck and dock type structures, said decking extrusion comprising:

an elongate base panel, said base panel having a first side edge and a spaced parallel second side edge;

a pair of spaced and parallel first lea members extending the length of said base panel, said first pair of leg members comprising a first leg member extending along the first side edge of the base panel and a second leg member spaced inwardly of said first leg member;

a pair of spaced and parallel second leg members extending the length of said base panel, said pair of second leg members comprising a third leg member extending along the second side edge of the base panel and a fourth leg member spaced inwardly of said third leg member, said pairs of leg members being spaced from and parallel to one another, each said leg member within each said pair of leg members having a distal end extending in a common and generally perpendicular direction away from said base panel;

each leg member of said pair of first leg members having a first locking element formed at its distal end, and each leg member of said pair of second leg members having a second locking element formed at its distal end; and said first locking elements of said pair of first leg members facing inwardly toward one another, and the second locking elements of said pair of second leg members facing outwardly and away from one another.

24. The decking extrusion of claim 23, wherein the first locking elements of said pair of first leg members are constructed and arranged to be resiliently urged away from one another, and the second locking elements of said pair of second leg members are constructed and arranged to be resiliently urged toward one another as a second locking element and a first locking element, respectively, of a second identical decking extrusion placed in a 180° reverse relationship with respect to said decking extrusion are engaged therewith and slidably passed thereover into an interlocked snap-fit with one another, respectively, to mate the two extrusions together for forming the decking member.

25. A decking extrusion for connection to a duplicate inverted decking extrusion and used to form a hollow decking member for use with outdoor deck and dock type structures, said decking extrusion comprising:

an elongate base panel having a first side edge and a spaced parallel second side edge;

a pair of spaced and parallel elongate first leg members extending the length of said base panel, said pair of first leg members comprising a first leg member extending along the first side edge of the base panel and a second leg member spaced inwardly of said first leg member;

an elongate second leg member extending the length of said base panel along said second side edge, said second leg member being spaced from and parallel to said first leg members;

each of said leg members having a distal end extending in a common and generally perpendicular direction away from said base panel;

said first leg members forming a first locking element at their respective distal ends;

and wherein said second leg member has a second locking element formed at its distal end; and said first locking element being sized and shaped to resiliently receive said second locking element between said first leg members, and said first leg members being sized and shaped to be resiliently urged away from each other as said second locking element of a duplicate decking extrusion in inverted relationship is urged between said first leg members as said second locking member is passed into interlocked snap-fit with said first locking element.

26. The decking extrusion of claim 25, wherein said second locking element comprises a wedge-shaped locking tab.

27. The decking extrusion of claim 26, wherein the first locking element at the distal end of each said first leg member comprises a minor leg member extending perpendicularly away from its respective leg member and facing inwardly toward the other one of said minor leg members.

28. The decking extrusion of claim 27, said wedge-shaped locking tab being sized and shaped to resiliently urge the minor leg members of a second identical decking extrusion placed in a 180° reverse relationship with respect to said decking extrusion outwardly and away from one another as said locking tab is passed therebetween and into a snap-fit for mating the two extrusions together to form the decking member.

29. A decking extrusion for connection to a duplicate inverted decking extrusion and forming a hollow deck plank to construct outdoor deck and dock type structures, said decking extrusion comprising:

an elongate base panel having a first side edge and a spaced parallel second side edge;

a first elongate leg member extending the length of said base panel along said first side edge; and a second elongate leg member extending the length of said base panel along said second side edge;

said leg members being spaced from and parallel to one another, each said leg member having a distal end extending in a common and generally perpendicular direction away from said base panel;

said first leg member including a first locking element comprising an elongate tab-receiving slot defined at its distal end and extending the length of said base panel and opening away from said base panel;

said second leg member including a raised locking tab defined at its distal end and extending the length of said base panel and facing away from said base panel;

said tab receiving slot of said first leg member being sized and shaped to resiliently receive a locking tab of a duplicate decking extrusion in a snap fit locked together relationship when a duplicate decking extrusion is placed in an aligned, overlying inverted relationship with said decking extrusion with its tab receiving slot and tab aligned with said tab and tab receiving slot, respectively, of said decking extrusion and said duplicate decking extrusion is urged toward said decking extrusion.

30. The decking extrusion of claim 29, further comprising:

an elongate stiffening leg member extending from said base panel and spaced intermediate and parallel to said first and said second leg members, respectively, said stiffening leg member extending the length of said base panel and having a distal end extending in said common and generally perpendicular direction away from said base panel, and a flange formed at the distal end of said stiffening leg member, said flange being parallel to said base panel;

said stiffening leg member being sized and shaped to engage a stiffening leg member of a duplicate decking extrusion in a load bearing relationship when a duplicate decking extrusion is locked in inverted overlying relationship with said decking extrusion.

31. A deck plank formed of first and second identical elongated extruded panels which are locked together in overlying reciprocal relationship, said extruded panels each comprising:

an elongated substantially flat base panel having opposed parallel first and second side edges extending along the length of said base panel, a first elongated side leg extending at a right angle with respect to said base panel along said first side edge and terminating in a first distal edge, and a second elongated side leg extending at a right angle with respect to said base panel along said second side edge and terminating in a second distal edge;

said first distal edge of said first side leg including a first load bearing mating surface and a first locking element, said first locking element having a tap facing away from said base panel;

said second distal edge of said second side leg including a second load bearing mating surface and a second locking element, said second locking element having a tap-receiving slot opening away frame said base panel;

said first locking elements of said first and second panels being shaped and sized to engage in locking relationship with said second locking elements of said first and second panels for locking said first and second panels together in snap fit facing, overlying reciprocal one over another relationship, with said first mating surfaces of said first side legs in load bearing relationship with said second mating surfaces of said second side legs, and said first and second side legs of said first panel and said first and second mating surfaces of said first panel aligned with and in load bearing relationship with the second and first side legs and said second and first mating surfaces of said second panel, respectively; and when said first and second elongated extruded panels are locked together, said base panel and said side legs of said first and said second panels are sized and shaped to form an elongated deck plank which is symmetrical in cross section and has an outside surface that is rectangular.

32. A deck plank formed of first and second identical elongated extruded panels which are locked together in overlying reciprocal relationship, said extruded panels each comprising: an elongated substantially flat base panel having opposed parallel first and second side edges extending along the length of said base panel;

a first pair of elongated leg members positioned adjacent said first side edge and extending parallel to each other in a common direction away from the base panel and parallel to said first side edge and at a right angle to said base panel and each leg member of said first pair of leg members terminating in a first distal edge;

a second pair of elongated leg members positioned adjacent said second side edge and extending parallel to each other in a common direction away from the base panel and parallel to said second edge and at a right angle to said base panel and each leg member of said second pair of leg members terminating in a second distal edge;

said first distal edges of said first pair of leg members each including a first load bearing mating surface and a first locking element;

said second distal edges of said second pair of leg members each including a second load bearing mating surface and a second locking element;

said first locking elements of said first and second panels being shaped and sized to engage in locking relationship with said second locking elements of said first and second panels for locking said first and second panels together in facing, overlying reciprocal relationship, with said first mating surfaces of said first leg members in load bearing relationship with said second mating surfaces of said second leg members, and said first and second pairs of leg members of said first panel and said first and second mating surfaces of said first panel aligned with and in load bearing relationship with said second and first pair of leg members and said second and first load bearing mating surfaces of said second panel, respectively; and said extruded panels being sized and shaped when locked together to form an elongated deck plank which is symmetrical in cross section.

33. The deck plank of claim 32, wherein:

said first locking elements and said second locking elements are constructed so that when they are urged together toward each other into a locked relationship said first locking elements urge said second locking elements apart as said second locking elements urge said first locking elements toward each other and said locking elements tend to guide said panels into aligned locked relationship.

34. The deck plank of claim 32, and further including:

a nonskid pattern extruded into said substantially flat base panel.

* * * * *